US011192358B2

(12) United States Patent
Takenaka et al.

(10) Patent No.: US 11,192,358 B2
(45) Date of Patent: Dec. 7, 2021

(54) DROPLET EJECTING DEVICE AND METHOD FOR TRANSMITTING, TO DRIVE CIRCUIT, A PLURALITY OF ITEMS OF INFORMATION USED TO DRIVE A PLURALITY OF DRIVE ELEMENTS

(71) Applicant: Brother Kogyo Kabushiki Kaisha, Nagoya (JP)

(72) Inventors: Yasuhiro Takenaka, Nagoya (JP); Toru Yamashita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/037,908

(22) Filed: Sep. 30, 2020

(65) Prior Publication Data

US 2021/0008876 A1 Jan. 14, 2021

Related U.S. Application Data

(63) Continuation of application No. PCT/JP2019/010499, filed on Mar. 14, 2019.

(30) Foreign Application Priority Data

Mar. 30, 2018 (JP) ..... JP2018-070119

(51) Int. Cl.
*B41J 2/045* (2006.01)
*B41J 2/21* (2006.01)

(52) U.S. Cl.
CPC ..... *B41J 2/04541* (2013.01); *B41J 2/04548* (2013.01); *B41J 2/2121* (2013.01)

(58) Field of Classification Search
CPC ..... B41J 2/2121; B41J 2/04596; B41J 2/04505; B41J 2/04503; B41J 2/04506;
(Continued)

(56) References Cited

U.S. PATENT DOCUMENTS 6,273,540 B1 8/2001 Takamura et al.
6,371,587 B1 4/2002 Chang
(Continued)

FOREIGN PATENT DOCUMENTS

CN 1426895 A 7/2003
JP 2001-301142 A 10/2001
(Continued)

OTHER PUBLICATIONS

May 14, 2019—International Search Report—Intl App PCT/JP2019/010499.
(Continued)

*Primary Examiner* — Kristal Feggins
(74) *Attorney, Agent, or Firm* — Banner & Witcoff, Ltd.

(57) ABSTRACT

A droplet ejecting device includes: a head including N-number drive elements; a driving circuit including N-number waveform signal selectors and N-number power supply circuit selectors; a plurality of power supply circuits connected to the driving circuit; and a control circuit. Each waveform signal selector selects a waveform signal to be outputted to the corresponding drive element from among a plurality of types of waveform signals. Each power supply circuit selectors selects a power supply circuit to be connected to the drive elements from among the plurality of power supply circuits. The control circuit serially transmits, to the driving circuit via a single control line: N-number items of waveform signal designation information each of which designates the waveform signal to be outputted to the corresponding drive element; and N-number items of power supply designation information each of which designates the power supply circuit to be connected to the corresponding drive element.

8 Claims, 10 Drawing Sheets

(58) Field of Classification Search
CPC ..... B41J 2/04508; B41J 2/04513; B41J 2/04515; B41J 2/04516; B41J 2/04525; B41J 2/04535; B41J 2/04551; B41J 2/04588; B41J 2/0459; B41J 2/04591; B41J 2/04541; B41J 2/04548; B41J 2/04; B41J 2/14; B41J 2/01
See application file for complete search history.

(56) References Cited

U.S. PATENT DOCUMENTS

| | | | | |
|---|---|---|---|---|
| 6,860,589 | B2 * | 3/2005 | Tamura | B41J 2/04581 347/50 |
| 6,866,367 | B2 * | 3/2005 | Szumla | B41J 2/04541 347/50 |
| 7,887,149 | B2 | 2/2011 | Kondoh | |
| 8,152,277 | B2 * | 4/2012 | Hatasa | B41J 2/17546 347/50 |
| 2008/0186339 | A1 | 8/2008 | Kondoh | |
| 2017/0259562 | A1 | 9/2017 | Van Brocklin | |
| 2017/0282547 | A1 | 10/2017 | Hatta | |

FOREIGN PATENT DOCUMENTS

| | | | |
|---|---|---|---|
| JP | 2002-001948 | A | 1/2002 |
| JP | 2008-197511 | A | 8/2008 |
| JP | 4992447 | B2 | 8/2012 |
| JP | 2015-006764 | A | 1/2015 |
| JP | 2015-024531 | A | 2/2015 |
| JP | 2016-093963 | A | 5/2016 |
| JP | 2017-177572 | A | 10/2017 |
| JP | 2018-047605 | A | 3/2018 |

OTHER PUBLICATIONS

Jan. 26, 2021—(JP) Notice of Reasons for Refusal—App 2018-070119, Eng Tran.
Oct. 6, 2020—(WO) International Preliminary Report on Patentability—App PCT/JP2019/010499, Eng Tran.
Aug. 3, 2021—(CN) Notification of First Office Action—App 201980023511.6, Eng Tran.

* cited by examiner

FIG. 6

| DOT SIZE DATA | WAVEFORM NUMBER | POWER SUPPLY NUMBER | DROPLET VOLUME |
|---|---|---|---|
| 0 | 0 | — | — |
| 1 | 1 | 1 | 2 |
| 2 | | 2 | 3 |
| 3 | | 3 | 4 |
| 4 | 2 | 1 | 6 |
| 5 | | 2 | 7 |
| 6 | | 3 | 8 |
| 7 | 3 | 1 | 11 |
| 8 | | 2 | 12 |
| 9 | | 3 | 13 |

| DOT SIZE DATA | WAVEFORM NUMBER | POWER SUPPLY NUMBER | DROPLET VOLUME |
|---|---|---|---|
| 0 | 0 | — | — |
| 1 | 1 | 1 | 2 |
| 2 | | 2 | 3 |
| 3 | | 3 | 5 |
| | 2 | 1 | 5 |
| 4 | | 2 | 7 |
| 5 | | 3 | 9 |
| | 3 | 1 | 9 |
| 6 | | 2 | 12 |
| 7 | | 3 | 13 |

FIG. 10

WHEN MOVING RIGHTWARD

| COLOR | K | Y | C | M |
|---|---|---|---|---|
| POWER SUPPLY NUMBER | 1 | 2 | 3 | 4 |

WHEN MOVING LEFTWARD

| COLOR | K | Y | C | M |
|---|---|---|---|---|
| POWER SUPPLY NUMBER | 4 | 3 | 2 | 1 |

FIG. 11

| DOT SIZE DATA | WAVEFORM NUMBER | POWER SUPPLY NUMBER | DROPLET VOLUME |
|---|---|---|---|
| 0 | 0 | — | — |
| 1 | 1 | 1 | 2.4 |
| | | 2 | 2.8 |
| | | 3 | 3.2 |
| | | 4 | 3.6 |
| 2 | 2 | 1 | 5.4 |
| | | 2 | 5.8 |
| | | 3 | 6.2 |
| | | 4 | 6.6 |
| 3 | 3 | 1 | 8.4 |
| | | 2 | 8.8 |
| | | 3 | 9.2 |
| | | 4 | 9.6 |

WHEN MOVING RIGHTWARD

WHEN MOVING LEFTWARD

DROPLET EJECTING DEVICE AND METHOD FOR TRANSMITTING, TO DRIVE CIRCUIT, A PLURALITY OF ITEMS OF INFORMATION USED TO DRIVE A PLURALITY OF DRIVE ELEMENTS

CROSS REFERENCE TO RELATED APPLICATION

This application is a by-pass continuation application of International Application No. PCT/JP2019/010499 filed Mar. 14, 2019 claiming priority from Japanese Patent Application No. 2018-070119 filed Mar. 30, 2018. The entire contents of the international application and the priority application are incorporated herein by reference.

TECHNICAL FIELD

The present disclosure relates to a droplet ejecting device that ejects liquid, such as ink, from nozzles.

BACKGROUND

A droplet ejecting device that ejects ink from a plurality of nozzles has conventionally been disclosed. The droplet ejecting device includes a drawing data memory that stores ejection data defining whether or not a drive signal is to be supplied to the piezoelectric element for each nozzle, and COM selection data defining the type of drive signal to be supplied to each piezoelectric element.

The COM selection data includes waveforms and peak values of drive voltages. The COM selection data is transmitted from the drawing data memory to a COM selection circuit, and the waveform and peak value of voltage is selected for driving each piezoelectric element. Also, the ejection data is transmitted from the drawing data memory to a switching circuit that supplies drive signals to prescribed piezoelectric elements based on the ejection data. Piezoelectric elements to which drive signals are supplied are driven according to the selected waveform and peak value for voltage.

SUMMARY

The drawing data memory and the COM selection circuit and switching circuit are connected to each other through a plurality of traces, which forms a complex circuit configuration.

In view of the foregoing, it is an object of the present disclosure to provide a droplet ejecting device capable of reducing the number of traces used to connect the control circuit to the drive circuit.

In order to attain the above and other objects, according to one aspect, the present disclosure provides a droplet ejection device including a head, a driving circuit, a plurality of power supply circuits, and a control circuit. The head includes N-number drive elements positioned to correspond to nozzles. The driving circuit is configured to drive the N-number drive elements. The plurality of power supply circuits is connected to the driving circuit. The control circuit is configured to transmit a signal to the driving circuit on the basis of image data constituted by a plurality of items of dot size data for designating a dot size to be formed for each pixel. The driving circuit includes N-number waveform signal selectors and N-number power supply circuit selectors. Each of N-number waveform signal selectors is configured to select, from among a plurality of types of waveform signals, a waveform signal to be outputted to a corresponding one of the N-number drive elements. Each of the N-number power supply circuit selectors is configured to select, from among the plurality of power supply circuits, a power supply circuit to be connected to the corresponding one of the N-number drive elements. The control circuit is configured to: determine, on the basis of the image data, N-number items of waveform signal designation information and N-number items of power supply designation information. Each of the N-number items of waveform signal designation information designates the waveform signal to be outputted to the corresponding one of the N-number drive elements. Each of the N-number items of power supply designation information designates the power supply circuit to be connected to the corresponding one of the N-number drive elements. The control circuit is further configured to serially transmit, via a single control line, the determined N-number items of waveform signal designation information and the determined N-number items of power supply designation information to the driving circuit. Each of the N-number waveform signal selectors is configured to select, according to the N-number items of waveform signal designation information received from the control circuit, the waveform signal to be outputted to the corresponding one of the N-number drive elements. Each of the N-number power supply circuit selectors is configured to select, according to the N-number items of power supply designation information received from the control circuit, the power supply circuit to be connected to the corresponding one of the N-number drive elements.

According to another aspect, the present disclosure provides a method for a droplet ejection device including a head, a driving circuit, and a plurality of power supply circuits. The head includes N-number drive elements positioned to correspond to nozzles. The driving circuit is configured to drive the N-number drive elements. The plurality of power supply circuits is connected to the driving circuit. The method includes: determining, on the basis of image data constituted by a plurality of items of dot size data for designating a dot size to be formed for each pixel: N-number items of waveform signal designation information, each designating a waveform signal to be outputted to a corresponding one of the N-number drive elements; and N-number items of power supply designation information, each designating a power supply circuit to be connected to the corresponding one of the N-number drive elements; serially transmitting, to the driving circuit via a single control line, the determined N-number items of waveform signal designation information and the determined N-number items of power supply designation information; selecting, for each of the N-number drive elements, the waveform signal from among a plurality of types of waveform signals according to the N-number items of waveform signal designation information received by the driving circuit; and selecting, for each of the N-number drive elements, the power supply circuit from among the plurality of power supply circuits according to the N-number items of power supply designation information received by the driving circuit.

BRIEF DESCRIPTION OF THE DRAWINGS

The particular features and advantages of the embodiment(s) as well as other objects will become apparent from the following description taken in connection with the accompanying drawings, in which:

FIG. 6 is a table showing the relationships between combinations of waveform numbers and power supply numbers and droplet volumes for respective items of dot size data;

FIG. 10 is a table illustrating relationships among head units for all ink colors and power supply numbers when an inkjet head is moved rightward, and relationships among the head units for all ink colors and power supply numbers when the inkjet head is moved leftward;

FIG. 11 is a table showing the relationships between combinations of waveform numbers and power supply numbers and droplet volumes for respective items of dot size data.

DETAILED DESCRIPTION

First Embodiment

Figure 1:
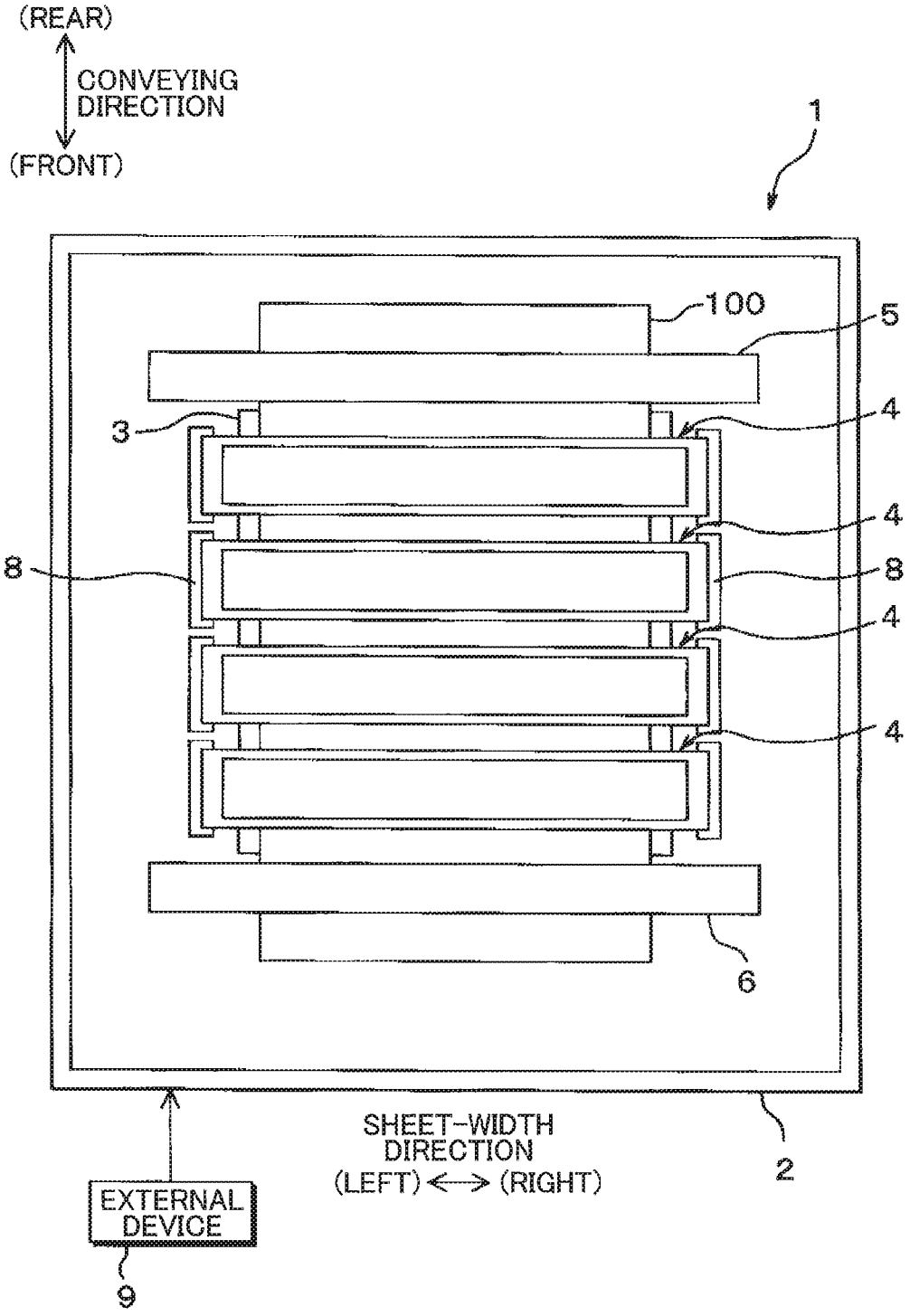
FIG. 1 is a plan view illustrating a printing device according to a first embodiment.

Hereinafter, the present disclosure will be described while referring to the drawings illustrating a printing device 1 according to a first embodiment of the present disclosure. FIG. 1 is a plan view illustrating the printing device 1. The printing device 1 is an inkjet printer, for example. For convenience, directions indicated by arrows in FIG. 1 will be used when describing front, rear, left, and right directions in this specification. The printing device 1 includes a housing 2.

Provided in the housing 2 are a platen 3, four inkjet heads 4, conveying rollers 5 and 6, a control unit (not illustrated), and the like. Note that the numbers of inkjet heads 4 and conveying rollers 5 and 6 are not limited to the example illustrated in FIG. 1.

A plurality of head retaining parts 8 are mounted in the housing 2. The head retaining parts 8 are juxtaposed in the front-rear direction at positions above the platen 3 and between the two conveying rollers 5 and 6. The inkjet heads 4 are retained by respective head retaining parts 8.

A recording medium 100 used in the printing device 1 is placed on the platen 3. The conveying rollers 5 and 6 are arranged on respective ends of the platen 3 in the front-rear direction. The recording medium 100 is conveyed along the front-rear direction (conveying direction) by the rotation of the conveying rollers 5 and 6.

The outer shape of each inkjet head 4 is rectangular in a plan view. The inkjet heads 4 are arranged such that their short sides are aligned in the conveying direction (front-rear direction) along which the recording medium 100 is conveyed, and their long sides are aligned in a direction orthogonal to the conveying direction (left-right direction). The inkjet heads 4 are disposed such that their nozzle surfaces oppose the platen 3. The four inkjet heads 4 are juxtaposed in the front-rear direction between the conveying roller 5 and conveying roller 6.

The four inkjet heads 4 correspond to cyan, magenta, yellow, and black, for example.

Each inkjet head 4 includes a plurality of head units 11 as a plurality of droplet ejecting devices. Each head unit 11 includes a circuit board 50 described later, and a flexible circuit board 60 described later. The flexible circuit board 60 is connected to the circuit board 50. In other words, one each of the circuit board 50 and flexible circuit board 60 is provided for one head unit 11. In a case where the printing device 1 includes four inkjet heads 4 and each inkjet head 4 includes nine head units 11, for example, the printing device 1 includes thirty-six head units 11. In this case, the printing device 1 has thirty-six circuit boards 50, and thirty-six flexible circuit boards 60 respectively connected to the circuit boards 50.

The printing device 1 has the control unit (not illustrated). The control unit activates a motor (not illustrated) and controls operations of the conveying rollers 5 and 6 to convey the recording medium 100. An external device 9 (a personal computer, for example) transmits signals for printing instructions, raster data for images to be printed, and the like to the circuit boards 50 described later. The external device 9 functions also as a receiver that receives user operations. The printing device 1 ejects ink toward the recording medium 100 from head units 11 in each inkjet head 4 while conveying the recording medium 100.

Figure 2:
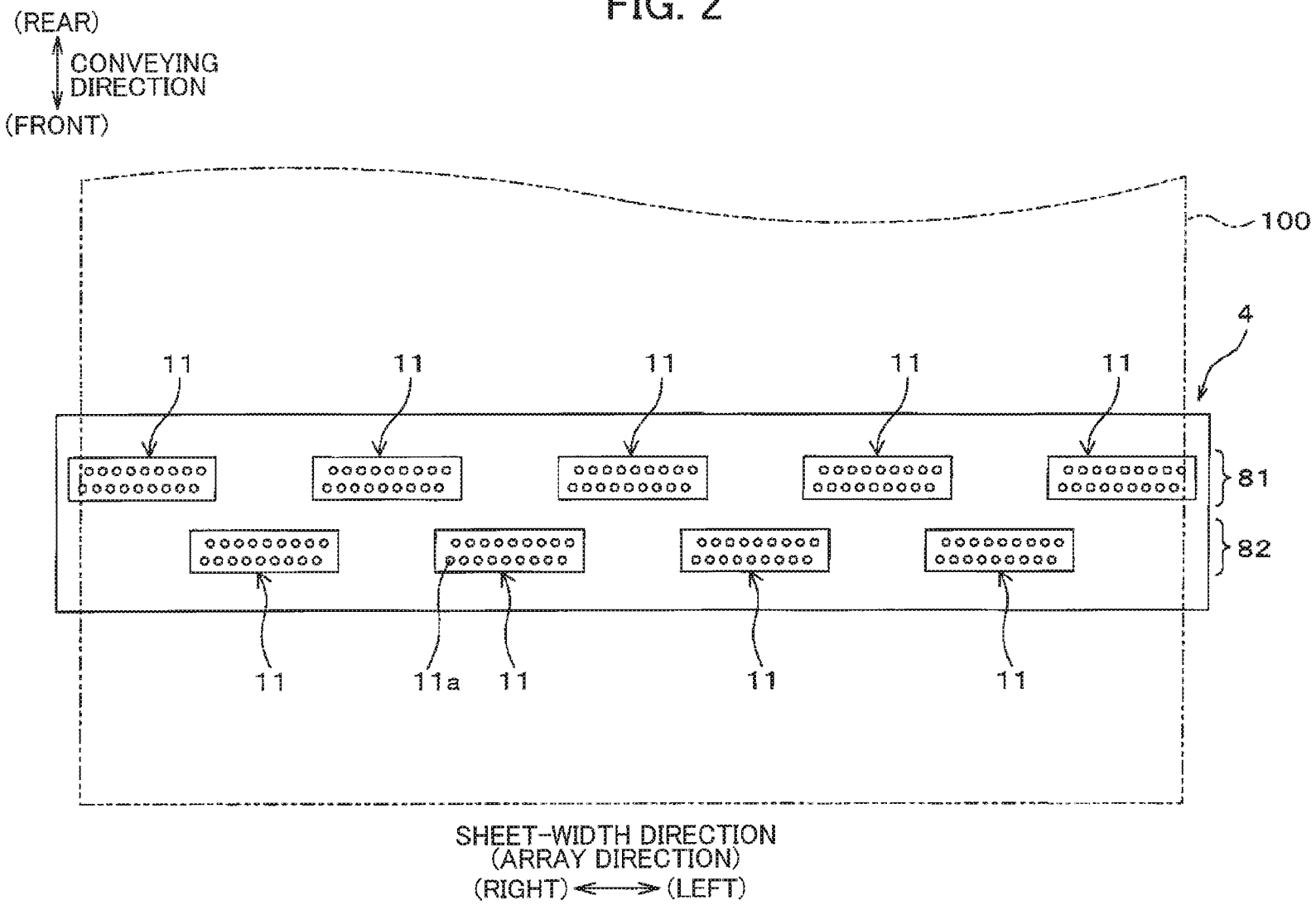
FIG. 2 is a plan view illustrating an example of a primary structure of an inkjet head when viewing the inkjet head from its nozzle surface side.

FIG. 2 is a plan view illustrating an example of the primary structure of the inkjet head 4 according to the present embodiment when viewing the inkjet head 4 from the nozzle surface side. The head units 11 are arranged in two rows juxtaposed in the front-rear direction. In a front row 82, four head units 11 are arranged along the left-right direction. In a rear row 81, five head units 11 are arranged along the left-right direction. A plurality of ejection openings 11*a* (openings) of the plurality of nozzles are provided in the nozzle surface (the bottom surface of a nozzle plate) of the head unit 11. Drive elements 111 (described later) of the same number as the ejection openings 11*a* of the nozzles are provided in the head unit 11. Note that the ejection openings 11*a* are schematically illustrated for convenience, but the actual arrangement and number of ejection openings 11*a* are different. Further, while the inkjet head 4 in the example of FIG. 2 includes nine head units 11, the number of head units 11 is not limited to nine. Each head unit 11 includes the circuit board 50 described later, the flexible circuit board 60 described later, and the like.

Figure 3:
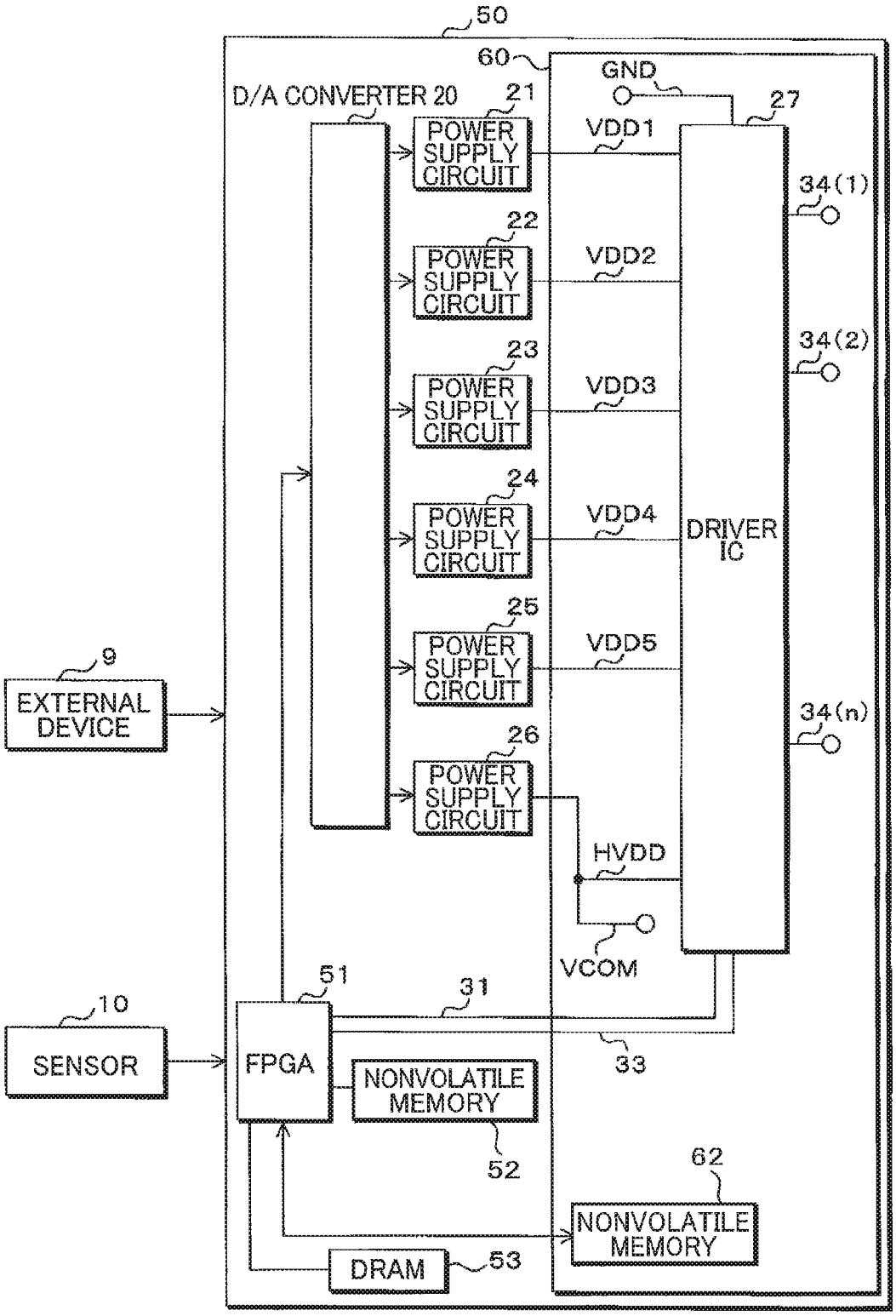
FIG. 3 is a block diagram illustrating examples of configurations of a circuit board and a flexible circuit board connected thereto that are possessed by a head unit.

FIG. 3 is a block diagram illustrating examples of configurations of the circuit board 50 and flexible circuit board 60 connected thereto that are provided in the head unit 11 according to the present embodiment. FIG. 3 depicts a single circuit board 50 and a single flexible circuit board 60.

The circuit board 50 includes a FPGA 51 serving as a controller; a nonvolatile memory 52, such as EEPROM; a DRAM 53 for temporarily storing raster data received from the external device 9; a D/A converter 20; a power supply circuit 21; a power supply circuit 22; a power supply circuit 23; a power supply circuit 24; a power supply circuit 25; a power supply circuit 26; and the like. Further, the flexible circuit board 60 includes a nonvolatile memory 62, such as EEPROM; a driver IC 27; and the like. Note that a control IC, such as a CPU (Central Processing Unit) or an MPU (Microprocessor Unit), may be used in place of the FPGA 51. The printing device 1 includes a sensor 10 for detecting the gap between the nozzle surface of the head unit 11 and the recording medium 100. The sensor 10 inputs the detected gap into the circuit board 50. The sensor 10 is configured of a conventionally known sensor, such as a photosensor or an ultrasonic sensor.

The FPGA 51 outputs, to the D/A converter 20, setting signals for setting the output voltages of the power supply circuits 21-26. The D/A converter 20 converts the digital setting signals outputted by the FPGA 51 to analog setting signals, and outputs the analog signals to the power supply circuits 21-26.

The power supply circuits 21-26 may be DC/DC converters configured of a plurality of electronic parts, such as FETs, inductors, resistors, and electrolytic capacitors, for example. Each of the power supply circuits 21-26 outputs, to the driver IC 27, an output voltage specified by the corresponding setting signal.

The power supply circuit 21 is connected to the driver IC 27 via a trace VDD1. The power supply circuit 22 is connected to the driver IC 27 via a trace VDD2. The power supply circuit 23 is connected to the driver IC 27 via a trace VDD3. The power supply circuit 24 is connected to the driver IC 27 via a trace VDD4. The power supply circuit 25 is connected to the driver IC 27 via a trace VDD5. The power supply circuit 26 is connected to the driver IC 27 via a trace HVDD. The power supply circuit 26 is also connected to the drive elements 111 described later via a trace VCOM. The trace HVDD and trace VCOM are configured of a trace leading out from the power supply circuit 26 that branches along the route into two traces.

Each of the power supply circuits 21-26 is connected to drive signal generating circuits **30(1)-30(*n*) formed inside the driver IC 27. Here, n is a natural number of 2 or greater. For example, n is equivalent to the number of drive elements 111 possessed by the head unit 11. The driver IC 27** will be described later in greater detail.

The power supply circuits 21-25 are normally used power supply circuits. The power supply circuit 26 is a power supply circuit with special specifications. The power supply circuit 26 can be used also as a power supply voltage for the VCOM of the drive elements 111 or as a high-side back gate voltage (HVDD) for PMOS transistors 311-315 described later. The magnitude of voltages outputted by the power supply circuits 21-25 have the following relationship, for example: voltage of power supply circuit 21<voltage of power supply circuit 22<voltage of power supply circuit 23<voltage of power supply circuit 24<voltage of power supply circuit 25.

The driver IC 27 is connected to the FPGA 51 via a single control line 33. The driver IC 27 is also connected to the n-number drive elements 111 via n-number signal lines **34(1)-34(*n*). Each signal line 34 is connected to an individual electrode of the corresponding drive element. The driver IC 27** is also connected to a trace GND, which is a ground wire.

Transmitted over the control line 33 are a waveform information signal for controlling n-number waveform signal selectors **91(1)-91(*n*) described later, and a power supply information signal for controlling n-number power supply circuit selectors 90(1)-90(*n*) described later, which selectors are possessed by the driver IC 27. The waveform information signal includes a signal for information related to n-number waveform numbers as n-number items of waveform signal designation information. Further, the power supply information signal includes a signal for information related to n-number power supply numbers as n-number items of power supply designation information. By controlling the n-number waveform signal selectors 91(1)-91(*n*) according to the n-number items of waveform signal designation information and by controlling the n-number power supply circuit selectors 90(1)-90(*n*) according to the n-number items of power supply designation information, the FPGA 51 selects a power supply circuit and a waveform signal for generating a drive signal to be outputted to each signal line 34. The driver IC 27 is also connected to the FPGA 51 via a control line 31. The driver IC 27 includes a waveform signal generating circuit 200 for generating waveform signals (0)-(6). The waveform signal generating circuit 200 generates the waveform signals (0)-(6) according to a control signal received via the control line 31. Note that a plurality of the control lines 31 may be provided, and the waveform signal generating circuit 200 may generate the waveform signals (0)-(6) according to a plurality of control signals received via the plurality of control lines 31**.

Figure 4:
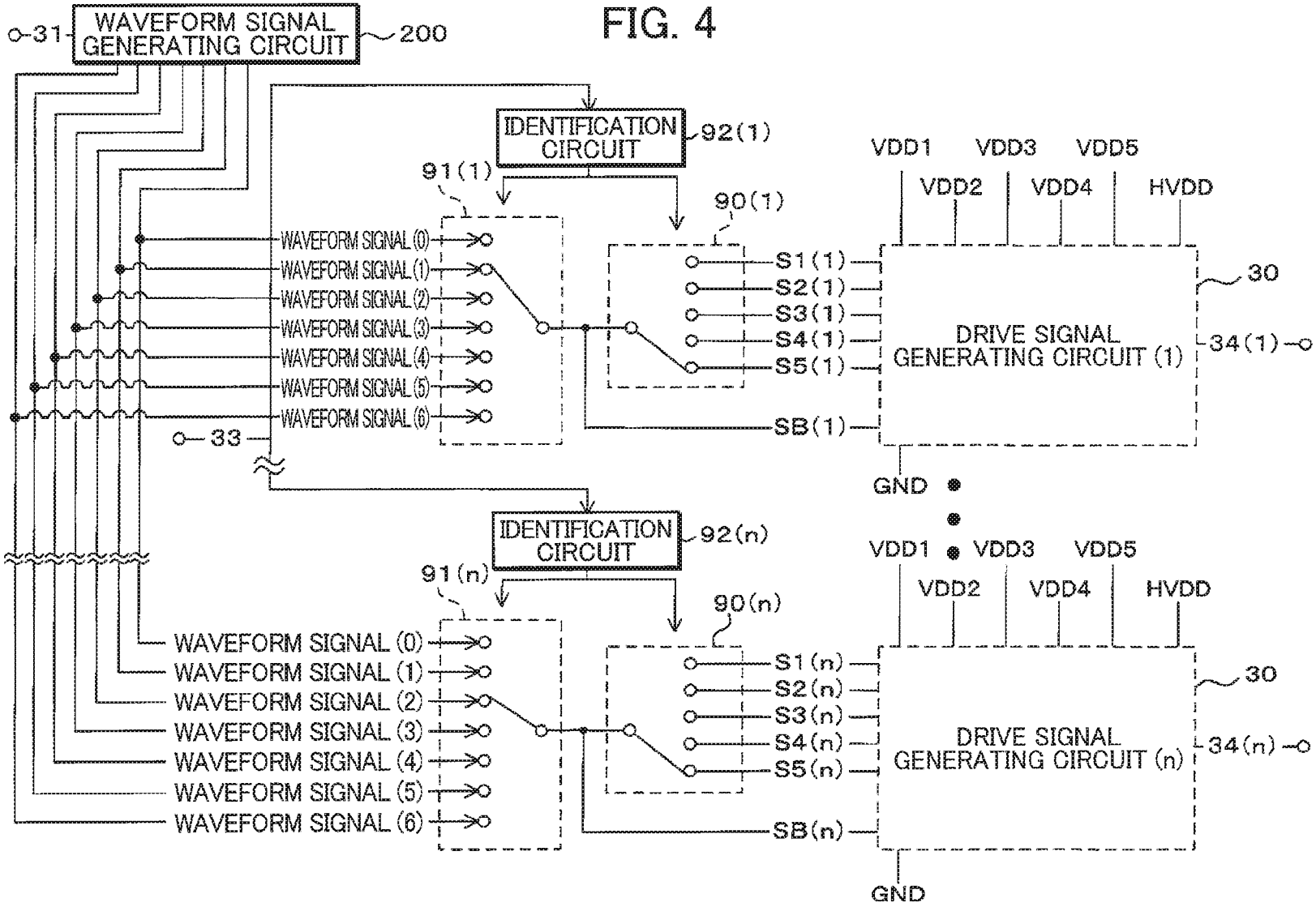
FIG. 4 is a block diagram illustrating an example of a circuit configuration possessed by a driver IC.
Figure 5:
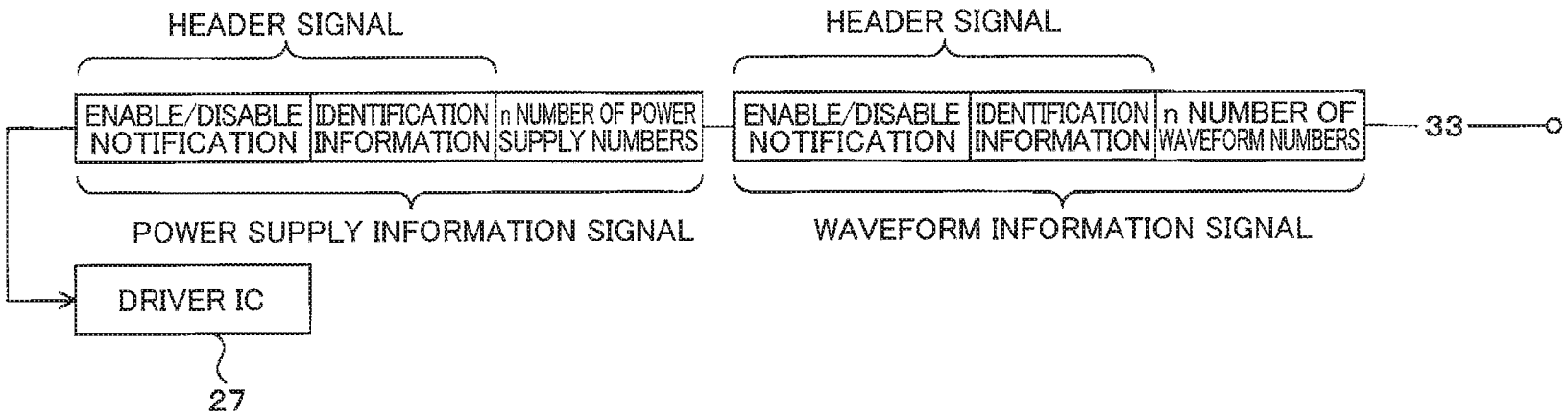
FIG. 5 is a conceptual diagram illustrating a power supply information signal and a waveform information signal that are transmitted over a control line.

FIG. 4 is a block diagram illustrating an example of a circuit configuration provided in the driver IC 27. FIG. 5 is a conceptual diagram illustrating the power supply information signal and waveform information signal transmitted over the control line 33. As illustrated in FIG. 4, the driver IC 27 includes the waveform signal generating circuit 200. The waveform signal generating circuit 200 generates seven different waveform signals (0)-(6) based on the control signal received from the control line 31. The waveform signals (0)-(6) are pulse signals for controlling transistors provided in the drive signal generating circuits 30. The pulse widths, pulse numbers, or the like of the waveform signals (0)-(6) are different from one another. The waveform signals (0)-(6) generated by the waveform signal generating circuit are supplied to each of the n-number power supply circuit selectors **90(1)-90(*n*)**.

As illustrated in FIG. 4, the driver IC 27 includes n-number identification circuits **92(1)-92(*n*). The n-number identification circuits 92(1)-92(*n*) are respectively connected to the n-number power supply circuit selectors 90(1)-90(*n*). Additionally, the n-number identification circuits 92(1)-92(*n*) are respectively connected to the n-number waveform signal selectors 91(1)-91(*n*). The n-number waveform signal selectors 91(1)-91(*n*) are respectively connected to the n-number power supply circuit selectors 90(1)-90(*n*). The n-number power supply circuit selectors 90(1)-90(*n*) are respectively connected to the n-number drive signal generating circuits 30(1)-30(*n*). The single control line 33 leading out from the FPGA 51 branches and is connected to each of the n-number identification circuits 92(1)-92(*n*)**.

The n-number power supply circuit selectors **90(1)-90(*n*) are provided to correspond to the n-number drive elements 111. The n-number waveform signal selectors 91(1)-91(*n*) are provided to correspond to the n-number drive elements 111. The power supply circuit selectors 90 and waveform signal selectors 91 are hardware components configured of a plurality of FETs or the like formed inside the driver IC 27**.

The driver IC 27 includes n-number copies of the same configuration, where n is the same number as the number of nozzles. Hence, the circuit configuration provided among the power supply circuit selector 90(1), waveform signal selector 91(1), and signal line 34(1) will be used as a representative example in the following description. A control line SB(1) branching off from a midpoint of the connection between the power supply circuit selector 90(1) and waveform signal selector 91(1) is connected to the drive signal generating circuit 30(1).

The power supply circuit selector 90(1) and drive signal generating circuit 30(1) are connected by five control lines S1(1), S2(1), S3(1), S4(1), and S5(1). Based on the power supply information signal, the power supply circuit selector 90(1) selects one of the five control lines S1(1), S2(1), S3(1), S4(1), and S5(1) and connects the selected one to the waveform signal selector 91(1) The five control lines S1(1), S2(1), S3(1), S4(1), and S5(1) correspond respectively to the five power supply circuits 21-25.

The drive signal generating circuit 30(1) is also connected to five traces connected to the traces VDD1-VDD5 described above, a trace connected to the trace HVDD described above, and a trace connected to the trace GND described above.

Each of the n-number power supply circuit selectors 90(1)-90(*n*) can select any one of the five power supply circuits 21-25. All seven waveform signals (0)-(6) are inputted into each of the n-number waveform signal selectors 91(1)-91(*n*). Each of the waveform signal selectors 91(1)-91(*n*) can select any one of the seven waveform signals (0)-(6).

As illustrated in FIG. 5, a combination of a power supply information signal and a waveform information signal is transmitted serially to the control line 33. The power supply information signal has n-number items of power supply designation information. The power supply designation information is information for identifying a power supply number. The waveform information signal has n-number items of waveform signal designation information. The waveform signal designation information is information for identifying a waveform number. In other words, the number of combinations of power supply designation information and waveform signal designation information identified by one set of a power supply information signal and a waveform information signal is n. Hereinafter, the n-number combinations described above will be also represented with the combinations (1)-(n). The n-number combinations (1)-(n) correspond to the respective n-number identification circuits 92(1)-92(*n*). All n-number combinations (1)-(n) are inputted into each of the identification circuits 92(1)-92(*n*). Each of the n-number identification circuits 92(1)-92(*n*) fetches only the combination (1)-(n) corresponding to itself. For example, the identification circuit 92(1) fetches only the corresponding combination (1) and not the other combinations (2)-(n).

The power supply information signal includes a header signal, and the power supply designation information designating the n-number power supply numbers. The header signal includes an enable/disable notification, and identification information. The enable/disable notification indicates whether data is to be held by the identification circuits 92(1)-92(*n*). For example, if a high-level signal is to be sustained for a fixed period, the enable/disable notification indicates that this notification is set to enable, i.e., data is to be held by the identification circuits 92(1)-92(*n*). If a high-level signal is not to be sustained for a fixed period, the enable/disable notification indicates that this notification is set to disable, i.e., data is not to be held by the identification circuits 92(1)-92(*n*). Based on the enable/disable notification, the identification circuits 92(1)-92(*n*) determine whether to hold fetched information.

The identification information is information for identifying whether the signal is a power supply information signal or a waveform information signal. For example, the identification circuits 92(1)-92(*n*) determine that the signal is a power supply information signal when the identification information indicates low-level, and that the signal is a waveform information signal when the identification information indicates high-level.

The power supply number included in the power supply information signal is a number for identifying one of the power supply circuits 21-25. The power supply number is an example of power supply designation information. In the present embodiment, power supply number 1 specifies the power supply circuit 21, power supply number 2 specifies the power supply circuit 22, power supply number 3 specifies the power supply circuit 23, power supply number 4 specifies the power supply circuit 24, and power supply number 5 specifies the power supply circuit 25. The identification circuits 92(1)-92(*n*) confirm the corresponding power supply number and controls the corresponding power supply circuit selectors 90(1)-90(*n*) to select one of the power supply circuits 21-25.

The waveform number included in the waveform information signal is a number for identifying one of the seven waveform signals (0)-(6). The waveform number is an example of waveform signal designation information. The identification circuits 92(1)-92(*n*) confirm the corresponding waveform number and controls the corresponding waveform signal selectors 91(1)-91(*n*) to select one of the waveform signals (0)-(6). Here, waveform signal (0) is a waveform used for nonejection.

For example, when the power supply number is 2 in combination (n), the identification circuit 92(*n*) controls the power supply circuit selector 90(*n*) to select the power supply circuit 22. Further, when the waveform number is 5 in combination (n), the identification circuit 92(*n*) controls the waveform signal selector 91(*n*) to select the waveform signal (5).

FIG. 6 is a table showing the relationships between combinations of waveform numbers and power supply numbers and droplet volumes for respective items of dot size data. Data illustrated in FIG. 6 and indicating the combinations of waveform numbers and power supply numbers corresponding to respective ones of the items of dot size data is stored in the nonvolatile memory 52. The items of dot size data in FIG. 6 indicates data for designating the dot size to be formed for each pixel. A single pixel corresponds to one drive element 111. Raster data received from the external device 9 includes a plurality of items of dot size data corresponding to respective ones of the drive elements 111. The droplet volume denotes the volume of ink to be ejected from the nozzle by driving the drive element 111. The droplet volume is expressed in units of picoliters, for example.

The items of dot size data in the example of FIG. 6 includes the dot size data 0-9. The dot size data 0 corresponds to the waveform number 0 and has no power supply number or droplet volume. In other words, dot size data 0 denotes nonejection. The combination of waveform number 1 and power supply number 1 is associated with dot size data 1, and the droplet volume ejected by this combination is 2 picoliters. The combination of waveform number 1 and power supply number 2 is associated with dot size data 2, and the droplet volume ejected by this combination is 3 picoliters. The combination of waveform number 1 and power supply number 3 is associated with dot size data 3, and the droplet volume ejected by this combination is 4 picoliters. The combination of waveform number 2 and power supply number 1 is associated with dot size data 4, and the droplet volume ejected by this combination is 6 picoliters. The combination of waveform number 2 and power supply number 2 is associated with dot size data 5, and the droplet volume ejected by this combination is 7 picoliters. The combination of waveform number 2 and power supply number 3 is associated with dot size data 6, and the droplet volume ejected by this combination is 8 picoliters. The combination of waveform number 3 and power supply number 1 is associated with dot size data 7, and the droplet volume ejected by this combination is 11 picoliters. The combination of waveform number 3 and power supply number 2 is associated with dot size data 8, and the droplet volume ejected by this combination is 12 picoliters. The combination of waveform number 3 and power supply number 3 is associated with dot size data 9, and the droplet volume ejected by this combination is 13 picoliters.

The FPGA 51 transmits combinations (1)-(n) of power supply designation information and waveform signal designation information to the driver IC 27 via the single control line 33 based on items of dot size data included in raster data received from the external device 9. The FPGA 51 references data stored in the nonvolatile memory 52 and indicating the relationships of the combinations of waveform numbers and power supply numbers corresponding to respective ones of the items of dot size data, and determines a combination corresponding to the dot size data included in the raster data for each of the n-number drive elements 111. Thereafter, the FPGA 51 transmits the n-number combinations (1)-(n) to the driver IC 27. In the driver IC 27, the identification circuits 92(1)-92(*n*) control the corresponding waveform signal selectors 91(1)-91(*n*) to select the waveform signal (0)-(6) specified by the waveform signal designation information and control the corresponding power supply circuit selectors 90(1)-(*n*) to select the power supply circuit 21-25 specified by the power supply designation information.

Figure 7:
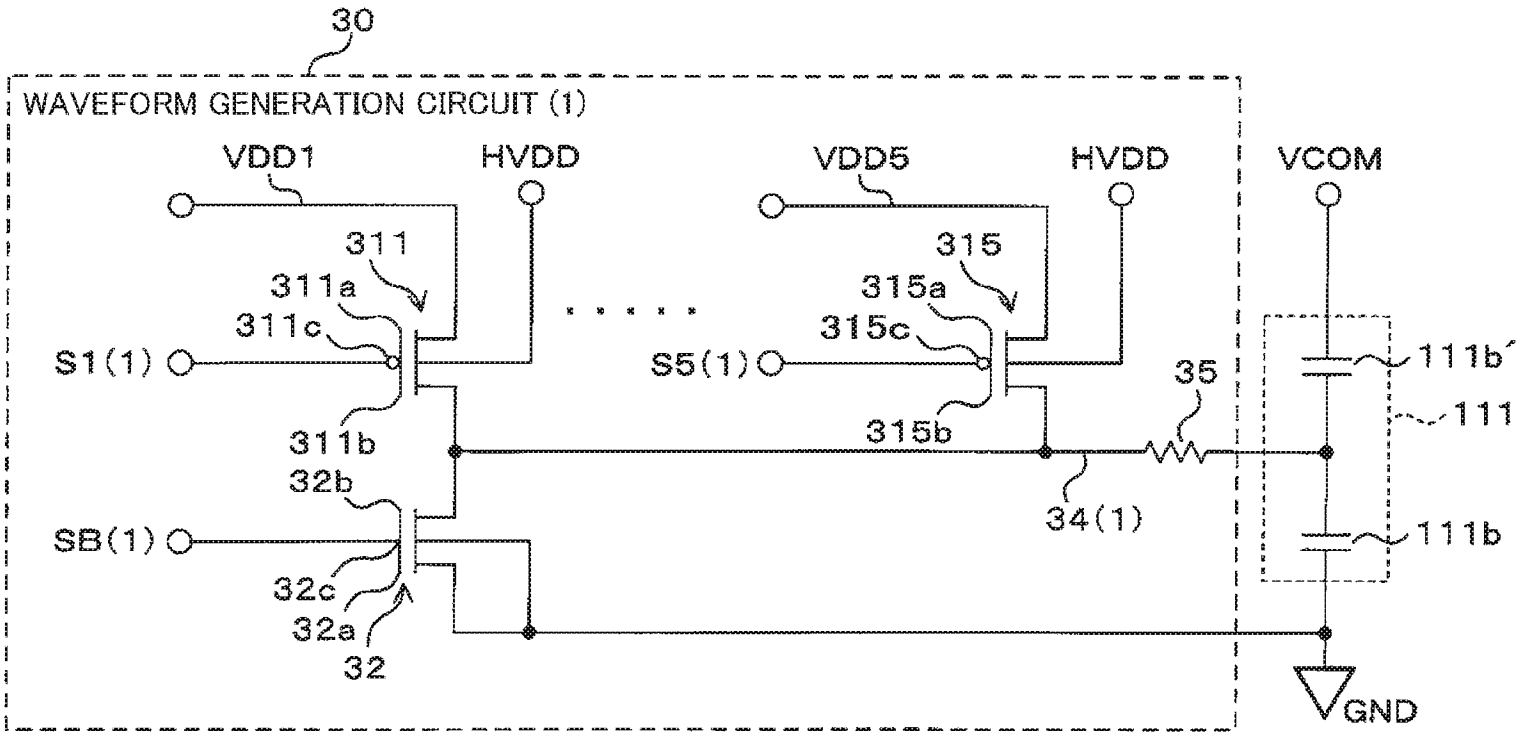
FIG. 7 is a circuit diagram illustrating an example of a configuration of a drive signal generating circuit possessed by the head unit.

FIG. 7 is a circuit diagram illustrating an example of a configuration of the drive signal generating circuit 30(1) provided in the head unit 11. Since the drive signal generating circuits 30(1)-30(*n*) have the same configuration, only the drive signal generating circuit 30(1) will be described with reference to FIG. 7. The drive signal generating circuit 30(1) includes five P-type metal oxide semiconductor (PMOS) transistors 311-315 (only two transistors are depicted in FIG. 7), a single N-type metal oxide semiconductor (NMOS) transistor 32, a resistor 35, and the like. The drive signal generating circuit 30(1) is connected to the individual electrode of the drive element 111 via the signal line 34(1).

The drive elements 111 in the present embodiment are piezoelectric elements as disclosed in FIG. 5 of Japanese Patent Application Publication No. 2015-24531 (Japanese Patent Application No. 2013-154357). Each drive element 111 is a piezoelectric element includes a first active portion interposed between the individual electrode and a first constant potential electrode, and a second active portion interposed between the individual electrode and a second constant potential electrode. Accordingly, each drive element 111 includes a capacitor 111*b*, and a capacitor 111*b*'.

The signal line 34(1) is connected to five source terminals 311*a*-315*a* of the five corresponding PMOS transistors 311-315. A source terminal 32*a* of the NMOS transistor 32 is connected to ground. An illustration of the PMOS transistors 312-314 is omitted from FIG. 7.

The control line S1(1) is connected to a gate terminal 311*c* of the PMOS transistor 311. The control line S2(1) is connected to a gate terminal 312*c* of the PMOS transistor 312. The control line S3(1) is connected to a gate terminal 313*c* of the PMOS transistor 313. The control line S4(1) is connected to a gate terminal 314*c* of the PMOS transistor 314. The control line S5(1) is connected to a gate terminal 315*c* of the PMOS transistor 315. Additionally, the control line SB(1) is connected to a gate terminal 32*c* of the NMOS transistor 32.

Further, the PMOS transistor 311 is connected to the power supply circuit 21 via the trace VDD1. The PMOS transistor 312 is connected to the power supply circuit 22 via the trace VDD2. The PMOS transistor 313 is connected to the power supply circuit 23 via the trace VDD3. The PMOS transistor 314 is connected to the power supply circuit 24 via the trace VDD4. The PMOS transistor 315 is connected to the power supply circuit 25 via the trace VDD5.

Further, drain terminals 311*b*-315*b* of the five corresponding PMOS transistors 311-315 are connected to one end of the resistor 35. A drain terminal 32*b* of the NMOS transistor 32 is connected to the one end of the resistor 35. The other end of the resistor 35 is connected to the individual electrode of the drive element 111 (another end of the capacitor 111*b*' and one end of the capacitor 111*b*). The first constant potential electrode of the drive element 111 (one end of the capacitor 111*b*') is connected to the VCOM, and the second constant potential electrode of the drive element 111 (the other end of the capacitor 111*b*) is connected to ground.

When the waveform signal selector 91(1) outputs a low-level ("L") signal to the power supply circuit selector 90(1), one of the PMOS transistors 311-315 connected to the signal line selected by the power supply circuit selector 90(1) switches to an ON state. Thus, the capacitor 111*b* is charged by the voltage supplied from one of the power supply circuits 21-25, and the capacitor 111*b*' is discharged. On the other hand, when the waveform signal selector 91(1) outputs a high-level ("H") signal to the power supply circuit selector 90(1), the NMOS transistor 32 switches to an ON state. Thus, the capacitor 111*b*' is charged by the voltage outputted from one of the power supply circuits 21-25, and the capacitor 111*b* is discharged. By alternately charging and discharging the capacitors 111*b* and 111*b*', the drive element 111 is deformed and ink is ejected from the ejection opening 11*a* of the nozzle.

That is, a drive signal for driving the drive element 111 is outputted to the signal line 34(1). By the power supply circuit selector 90(1) selecting one of the five control lines S1(1)-S5(1) as a control line to be connected, a power supply circuit for generating the drive signal can be selected from among the five power supply circuits 21-25.

Next, operations of the head unit 11 according to the present embodiment will be described. The FPGA 51 transmits combinations (1)-(n) of power supply designation information and waveform signal designation information to the driver IC 27 via the single control line 33 based on items of dot size data received from the external device 9. In the driver IC 27, the identification circuits 92(1)-92(*n*) control the corresponding waveform signal selectors 91(1)-91(*n*) to select the waveform signal (0)-(6) indicated by the waveform signal designation information, and control the corresponding power supply circuit selectors 90(1)-90(*n*) to select the power supply circuits 21-25 indicated by the power supply designation information. The waveform signal selected in each of the waveform signal selectors 91(1)-91

($n$) is converted into a prescribed voltage having a waveform defined by the selected waveform signal and having voltage level determined by the power supply circuit selected by the corresponding one of the power supply circuit selectors 90(1)-90($n$), and the resultant voltage is inputted into the corresponding one of the drive signal generating circuits 30(1)-30($n$). The drive element 111 is driven based on the pulse width and pulse number defined by the inputted waveform signal and a drive signal having the peak value defined by the output voltage of the selected power supply circuit, and a droplet having the droplet volume corresponding to the dot size data is ejected from the ejection opening 11*a* of the nozzle (see FIG. 6).

In the printing device 1 according to the first embodiment, the FPGA 51 serially transmits a set of a power supply information signal and a waveform information signal (n items of waveform signal designation information and n-number items of power supply designation information) to the driver IC 27 via the single control line 33. Accordingly, the printing device 1 can reduce the number of traces connecting the FPGA 51 to the driver IC 27.

Second Embodiment

Figures 8, 9:
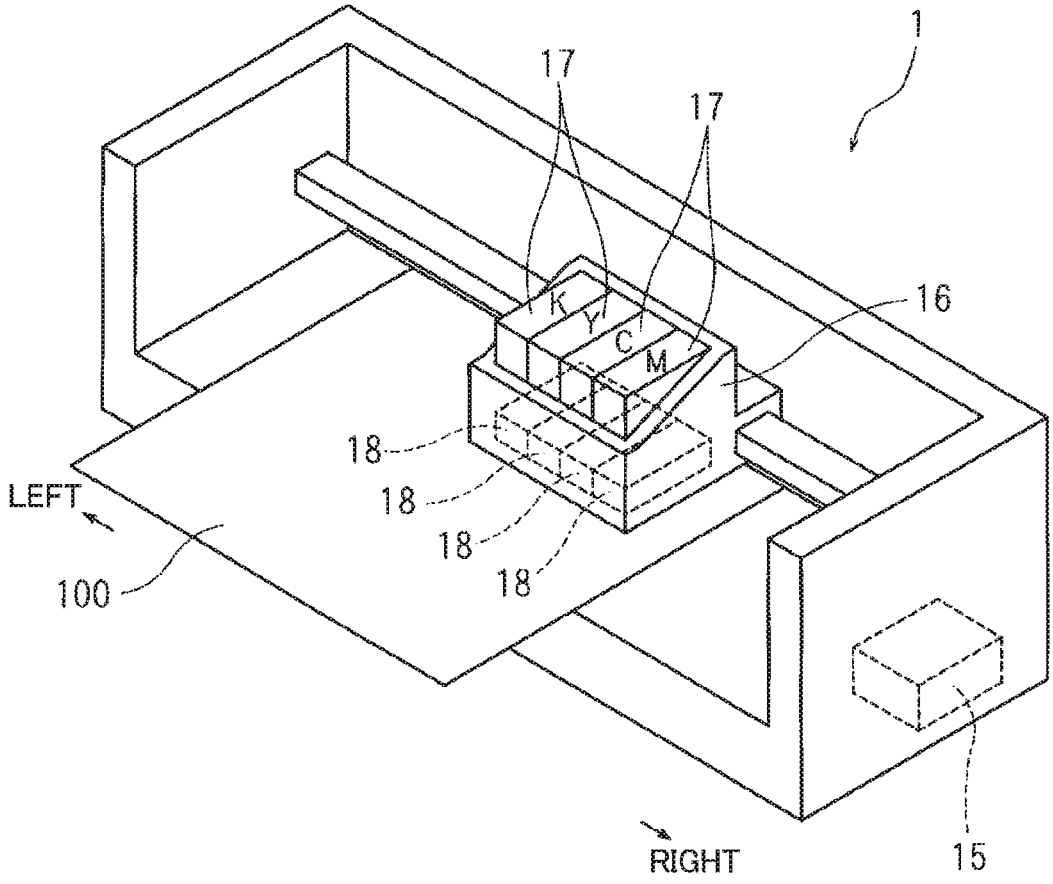
FIG. 8 is a table showing the relationships between combinations of waveform numbers and power supply numbers and droplet volumes for respective items of dot size data according to a second embodiment.
FIG. 9 is a schematic perspective view illustrating a printing device according to a third embodiment.

Next, the printing device 1 according to a second embodiment will be described. FIG. 8 is a table illustrating the relationship between combinations of waveform numbers and power supply numbers and droplet volumes for respective items of dot size data. The items of dot size data in FIG. 8 includes the dot size data 0-7. The dot size data 0 corresponds to the waveform number 0 and has no power supply number, droplet volume, or combination thereof. In other words, the dot size data 0 denotes nonejection. The dot size data 1 corresponds to the combination of waveform number 1 and power supply number 1 and is associated with a dot having a size formed by a droplet whose droplet volume is approximately 2 picoliters. The dot size data 2 corresponds to the combination of waveform number 1 and power supply number 2 and is associated with a dot having a size formed by a droplet whose droplet volume is approximately 3 picoliters. The dot size data 3 corresponds to two combinations, namely, the combination of waveform number 1 and power supply number 3 and the combination of waveform number 2 and power supply number 1. The dot size data 3 is associated with a dot having a size formed by a droplet whose droplet volume is approximately 5 picoliters. The dot size data 4 corresponds to the combination of waveform number 2 and power supply number 2 and is associated with a dot having a size formed by a droplet whose droplet volume is approximately 7 picoliters. The dot size data 5 corresponds to both the combination of waveform number 2 and power supply number 3 and the combination of waveform number 3 and power supply number 1. The dot size data 5 is associated with a dot having a size formed by a droplet whose droplet volume is approximately 9 picoliters. The dot size data 6 corresponds to the combination of waveform number 3 and power supply number 2 and is associated with a dot having a size formed by a droplet whose droplet volume is approximately 12 picoliters. The dot size data 7 corresponds to the combination of waveform number 3 and power supply number 3 and is associated with a dot having a size formed by a droplet whose droplet volume is approximately 13 picoliters.

Hence, when forming dots corresponding to the dot size data 3 in the second embodiment, droplets are ejected using the power supply circuit 23 in some cases and ejected using the power supply circuit 21 in other cases. Note that the voltage outputted from the power supply circuit 23 is greater than the voltage outputted from the power supply circuit 21.

Similarly, when forming dots corresponding to the dot size data 5 in the second embodiment, droplets are ejected using the power supply circuit 23 in some cases and ejected using the power supply circuit 21 in other cases.

When the external device 9 receives a user operation and the FPGA 51 receives "3" from the external device 9, the FPGA 51 selects one of two combinations, namely, the combination of waveform number 1 and power supply number 3 and the combination of waveform number 2 and power supply number 1. If there exists another combination for ejecting the same droplet volume as the droplet volume corresponding to the received dot size data, for example, the FPGA 51 may select the combination that uses the lower voltage. Similarly, when the FPGA 51 receives "5" from the external device 9 as the dot size data, the FPGA 51 selects one of two combinations, namely, the combination of waveform number 2 and power supply number 3 and the combination of waveform number 3 and power supply number 1.

An application example of the second embodiment in which a plurality of combinations of waveform numbers and power supply numbers is correlated with a single item of dot size data as illustrated in FIG. 8, will be described. When a nozzle ejects a droplet to perform printing, a main drop is ejected. However, droplets other than the main droplet, such as mist or droplets known as satellites, tend to be produced as the voltage for driving the drive element 111 is increased. Mist or satellites are unintended droplets that lead to a decline in printing quality. In a droplet ejecting device that performs high-resolution printing, such as when printing photos or the like on glossy paper and the like, for example, the FPGA 51 may select the combination that uses the lower voltage when there exists a plurality of combinations for ejecting the same droplet volume, as described above, thereby preventing a decline in printing quality.

As another application example of the second embodiment, the FPGA 51 may perform the following process. When the FPGA 51 receives "3" as the dot size data, the FPGA 51 fetches the gap between the nozzle surface of the head unit 11 and the recording medium 100 from the sensor 10. When the gap is greater than or equal to a preset threshold, the FPGA 51 selects the combination of waveform number 1 and power supply number 3. Similarly, when the FPGA 51 receives "5" as the dot size data, the FPGA 51 selects the combination of waveform number 2 and power supply number 3. In other words, the FPGA 51 may select the combination that uses the higher voltage when there exists a plurality of combinations for ejecting the same droplet volume.

Since the recording medium 100 and the nozzle surface move relative to each other, droplet impact positions on the recording medium 100 tend to deviate from their target positions when the gap grows between the nozzle surface of the head unit 11 and the recording medium 100. Accordingly, when there is a plurality of combinations for ejecting the same droplet volume, as described above, the FPGA 51 selects the combination that uses the higher voltage, thereby increasing the speed at which the droplet is ejected from the nozzle to suppress deviation in impact position.

When performing textile printing in particular, the recording medium 100 is a cloth or woven fabric, for example. Consequently, the recording medium 100 is napped and may come into contact with the nozzles. To prevent such contact, the gap between the nozzle surface and the recording medium 100 tends to be increased in textile printing. In such cases, the combination using the higher voltage may be selected, as described above, to effectively suppress deviations in droplet impact positions.

If the FPGA 51 has received a user command to perform textile printing, the FPGA 51 may simply select the combination using the higher voltage when there exists a plurality of combinations for ejecting the same droplet volume, irrespective of the detection value outputted by the sensor 10 or even when no sensor 10 has been provided.

Further, in a case where the initial values for droplet volumes stored in the nonvolatile memory 52 has been altered during the manufacturing process of the printing device 1 such that a plurality of combinations exists for ejecting the same droplet volume, as illustrated in FIG. 8, the FPGA 51 may select the combination using the lower voltage or may select the combination using the higher voltage, as described in the second embodiment or its variations.

Here, another application example of the second embodiment will be described in which a plurality of combinations of waveform numbers and power supply numbers is correlated with one item of dot size data, as illustrated in FIG. 8. The FPGA 51 may perform the following process.

When the external device 9 receives a user operation and the FPGA 51 receives "3" from the external device 9 as the dot size data corresponding to a certain drive element 111, the FPGA 51 can select one of two combinations, namely, the combination of waveform number 1 and power supply number 3 and the combination of waveform number 2 and power supply number 1. At this time, the FPGA 51 may compare the number of drive elements 111 that are connected to the power supply circuit 23 corresponding to power supply number 3, and the number of drive elements 111 that are connected to the power supply circuit 21 corresponding to power supply number 1 for the same printing interval, and may select a combination corresponding to the dot size data 3 such that the power supply circuit having the fewer drive elements 111 connected thereto is used. For example, when the number of drive elements 111 connected to the power supply circuit 21 is greater than the number of drive elements 111 connected to the power supply circuit 23 for the same printing interval, the FPGA 51 selects the combination of waveform number 2 and power supply number 3 as the combination for this drive element 111. Hence, the load can be dispersed between the power supply circuit 21 and the power supply circuit 23 within this printing interval. The FPGA 51 determines the power supply number and waveform number for each drive element 111 based on combinations selected for distributing load in this way. Next, the FPGA 51 transmits a power supply information signal having the determined power supply numbers and a waveform information signal having the determined waveform numbers to the driver IC 27.

Note that, also when receiving "5" from the external device 9 as the dot size data, the FPGA 51 can select a combination from two combinations, namely, the combination of waveform number 2 and power supply number 3 and the combination of waveform number 3 and power supply number 1. Therefore, also when "5" is received as the dot size data, the FPGA 51 may select one of the two combinations, namely, the combination of waveform number 2 and power supply number 3 and the combination of waveform number 3 such that the number of connected drive elements 111 in this printing interval is reduced.

When a plurality of combinations exists for the same dot size data as described above, the FPGA 51 selects the combination using the power supply circuit having the fewest drive elements connected thereto in the same printing interval, i.e., the power supply circuit with a smaller usage rate, thereby distributing load among the power supply circuits.

Components in the second embodiment having the same configuration as those in the first embodiment are designated with the same reference numerals, and detailed descriptions thereto are omitted.

Third Embodiment

Next, the printing device 1 according to a third embodiment will be described. FIG. 9 is a schematic perspective view illustrating the printing device 1. The printing device 1 according to the third embodiment is a scanning-type printing device that moves an inkjet head along a direction intersecting the moving direction of the recording medium 100. As illustrated in FIG. 9, the printing device 1 includes an inkjet head 16, a conveying mechanism (not illustrated) for conveying the recording medium 100, and a moving mechanism (not illustrated) for moving the inkjet head 16. The moving mechanism includes a motor, and an encoder 15 that detects the rotated angle and rotating direction of the motor. Detection results of the encoder 15 are inputted into the circuit board 50. The FPGA 51 determines the moving direction of the inkjet head 16 based on the detection results inputted from the encoder 15. The inkjet head 16 is moved in the left-right direction, for example.

The inkjet head 16 includes a plurality of ink tanks 17, and a plurality of head units 18. The head units 18 eject ink toward the recording medium 100. The printing device 1 uses ink in a plurality of colors, and one ink tank 17 and one head unit 18 are provided for each color. For example, the printing device 1 uses four ink colors, namely, cyan (C), magenta (M), yellow (Y), and black (K), and the inkjet head 16 has four ink tanks 17 and four head units 18. The black (K) ink tank 17 is disposed farthest to the left, the yellow (Y) ink tank 17 is disposed on the right side of the black (K) ink tank 17, the cyan (C) ink tank 17 is disposed on the right side of the yellow (Y) ink tank 17, and the magenta (M) ink tank 17 is disposed on the right side of the cyan (C) ink tank 17. The ink tanks 17 and head units 18 have a one-on-one correspondence to each other, and ink is supplied from each ink tank 17 to the corresponding head unit 18. As in the first embodiment, the head unit 18 has a nozzle surface, and ejection openings 11*a* of a plurality of nozzles are provided in this nozzle surface.

FIG. 10 is a table illustrating relationships among the head units 18 for all ink colors and power supply numbers when the inkjet head 16 is moved rightward, and relationships among the head units 18 for all ink colors and power supply numbers when the inkjet head 16 is moved leftward. The relationships illustrated in FIG. 10 among the head units 18 for all ink colors and power supply numbers when the inkjet head 16 is moved rightward and the relationships illustrated in FIG. 10 among the head units 18 for all ink colors and power supply numbers when the inkjet head 16 is moved leftward are stored in the nonvolatile memory 52.

As indicated in the upper table of FIG. 10, when the inkjet head 16 is moved rightward, power supply number 1 is correlated with the head unit 18 corresponding to black (K); power supply number 2 is correlated with the head unit 18 corresponding to yellow (Y); power supply number 3 is correlated with the head unit 18 corresponding to cyan (C); and power supply number 4 is correlated with the head unit 18 corresponding to magenta (M). As described above, the magnitudes of voltages outputted by the power supply circuits have the relationship: voltage of power supply circuit 21<voltage of power supply circuit 22<voltage of power supply circuit 23<voltage of power supply circuit 24. In other words, the voltage used in the head unit 18 for black (K) is the highest; the voltage used in the head unit 18 for yellow (Y) is the next highest; the voltage used in the head unit 18 for cyan (C) is the next highest; and the voltage used in the head unit 18 for magenta (M) is the lowest.

As indicated in the lower table of FIG. 10, when the inkjet head 16 is moved leftward, power supply number 4 is correlated with the head unit 18 corresponding to black (K); power supply number 3 is correlated with the head unit 18 corresponding to yellow (Y); power supply number 2 is correlated with the head unit 18 corresponding to cyan (C); and power supply number 1 is correlated with the head unit 18 corresponding to magenta (M). As described above, the magnitudes of voltages outputted by the power supply circuits have the relationship: voltage of power supply circuit 21<voltage of power supply circuit 22<voltage of power supply circuit 23<voltage of power supply circuit 24. In other words, the voltage used in the head unit 18 for magenta (M) is the highest; the voltage used in the head unit 18 for cyan (C) is the next highest; the voltage used in the head unit 18 for yellow (Y) is the next highest; and the voltage used in the head unit 18 for black (K) is the lowest.

The FPGA 51 determines the moving direction of the inkjet head 16 based on detection results inputted from the encoder 15. The FPGA 51 uses the relationships in the upper table of FIG. 10 when determining that the moving direction is rightward and uses the relationships in the lower table of FIG. 10 when determining that the moving direction is leftward.

FIG. 11 is a table illustrating relationships between combinations of waveform numbers and power supply numbers and droplet volumes for respective items of dot size data. The items of dot size data illustrated in FIG. 11 includes dot size data 0-3. The dot size data 0 corresponds to the waveform number 0 and has no power supply number, droplet volume, or combination thereof. In other words, the dot size data 0 denotes nonejection. The dot size data 1 corresponds to the combination of waveform number 1 and power supply number 1, the combination of waveform number 1 and power supply number 2, the combination of waveform number 1 and power supply number 3, and the combination of waveform number 1 and power supply number 4. The combination of waveform number 1 and power supply number 1 is correlated with a droplet volume of approximately 2.4 picoliters and corresponds to black (K) for rightward movement and magenta (M) for leftward movement. The combination of waveform number 1 and power supply number 2 is correlated with a droplet volume of approximately 2.8 picoliters and corresponds to yellow (Y) for rightward movement and cyan (C) for leftward movement. The combination of waveform number 1 and power supply number 3 is correlated with a droplet volume of approximate 3.2 picoliters and corresponds to cyan (C) for rightward movement and yellow (Y) for leftward movement. The combination of waveform number 1 and power supply number inkjet head 4 is correlated with a droplet volume of approximately 3.6 picoliters and corresponds to magenta (M) for rightward movement and black (K) for leftward movement.

The dot size data 2 corresponds to the combination of waveform number 2 and power supply number 1, the combination of waveform number 2 and power supply number 2, the combination of waveform number 2 and power supply number 3, and the combination of waveform number 2 and power supply number 4. The combination of waveform number 2 and power supply number 1 is correlated with a droplet volume of approximately 5.4 picoliters and corresponds to black (K) for rightward movement and magenta (M) for leftward movement. The combination of waveform number 2 and power supply number 2 is correlated with a droplet volume of approximately 5.8 picoliters and corresponds to yellow (Y) for rightward movement and cyan (C) for leftward movement. The combination of waveform number 2 and power supply number 3 is correlated with a droplet volume of approximately 6.2 picoliters and corresponds to cyan (C) for rightward movement and yellow (Y) for leftward movement. The combination of waveform number 2 and power supply number 4 is correlated with a droplet volume of approximately 6.6 picoliters and corresponds to magenta (M) for rightward movement and black (K) for leftward movement.

The dot size data 3 corresponds to the combination of waveform number 3 and power supply number 1, the combination of waveform number 3 and power supply number 2, the combination of waveform number 3 and power supply number 3, and the combination of waveform number 3 and power supply number 4. The combination of waveform number 3 and power supply number 1 is correlated with a droplet volume of approximately 8.4 picoliters and corresponds to black (K) for rightward movement and magenta (M) for leftward movement. The combination of waveform number 3 and power supply number 2 is correlated with a droplet volume of approximately 8.8 picoliters and corresponds to yellow (Y) for rightward movement and cyan (C) for leftward movement. The combination of waveform number 3 and power supply number 3 is correlated with a droplet volume of approximately 9.2 picoliters and corresponds to cyan (C) for rightward movement and yellow (Y) for leftward movement. The combination of waveform number 3 and power supply number 4 is correlated with a droplet volume of approximately 9.6 picoliters and corresponds to magenta (M) for rightward movement and black (K) for leftward movement.

Figure 12:
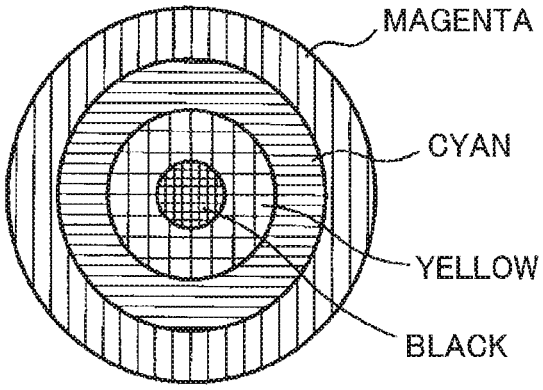
FIG. 12 is a diagram illustrating examples of a state in which four colors of ink are sequentially superimposed for a prescribed pixel while the inkjet head is moved rightward, and a state in which the four colors of ink are sequentially superimposed for a prescribed pixel while the inkjet head is moved leftward.
Figure 12:
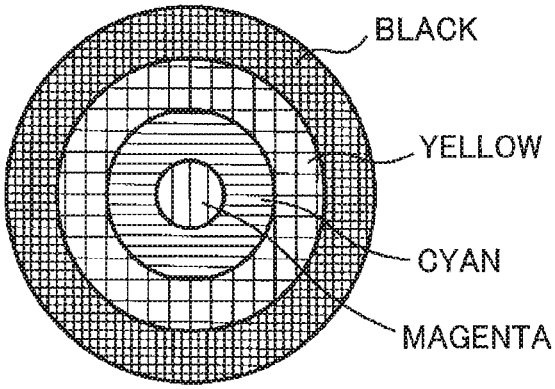

FIG. 12 is a diagram illustrating examples of a state in which the four colors of ink are sequentially superimposed for a prescribed pixel while the inkjet head 16 is moved rightward, and a state in which the four colors of ink are sequentially superimposed for a prescribed pixel while the inkjet head 16 is moved leftward. In FIG. 12, ink for all colors has been ejected from the inkjet head 16 based on the dot size data 2. Here, the dot size data 2 is merely one example of a plurality of items of dot size data. Ink in each color may be ejected from the inkjet head 16 based on the dot size data 1 or the dot size data 3, for example. The upper diagram in FIG. 12 illustrates the state in which ink in the four colors are sequentially superimposed for a prescribed pixel while the inkjet head 16 is moved rightward, and the lower diagram in FIG. 12 illustrates the state in which ink in the four colors are sequentially superimposed for a prescribed pixel while the inkjet head 16 is moved leftward.

When the inkjet head 16 is moved rightward, ink is ejected in the order magenta (M), cyan (C), yellow (Y), and black (K), so that cyan (C) is superimposed on top of magenta (M), yellow (Y) is superimposed on top of cyan (C), and black (K) is superimposed on top of yellow (Y), as illustrated in the upper diagram of FIG. 12. Based on the power supply numbers described above (see the upper table of FIG. 10 and FIG. 11), i.e., the relationships of operating voltages, magenta (M) has the largest droplet volume, i.e., the largest deposition area on the recording medium 100, cyan (C) the next largest, yellow (Y) the next largest, and black (K) the smallest. Magenta (M) has the largest area overlapped by other colors, cyan (C) the next largest, yellow (Y) the next largest, and black (K) is not overlapped by other colors. Hence, the area of the portion of a color that is overlapped by other colors is larger or smaller as the size of the deposition area of that color is larger or smaller.

When the inkjet head 16 is moved leftward, ink is ejected in the sequence black (K), yellow (Y), cyan (C), and magenta (M), so that yellow (Y) is superimposed on top of black (K), cyan (C) is superimposed on top of yellow (Y), and magenta (M) is superimposed on top of cyan (C), as illustrated in the lower diagram of FIG. 12. Based on the power supply numbers described above (see the lower table of FIG. 10 and FIG. 11), i.e., the relationships of the operating voltages, black (K) has the largest droplet volume, i.e., the largest deposition area on the recording medium 100, yellow (Y) the next largest, cyan (C) the next largest, and magenta (M) the smallest. Black (K) has the largest area overlapped by other colors, yellow (Y) the next largest, cyan (C) the next largest, and magenta (M) is not overlapped by other colors. Hence, the area of the portion of a color that is overlapped by other colors is larger or smaller as the size of the deposition area for that color is larger or smaller.

The case of overlapping black (K) with yellow (Y) will be described. When the inkjet head 16 is moved rightward, black (K) is superimposed over yellow (Y). When the inkjet head 16 is moved leftward, yellow (Y) is superimposed over black (K). The ratio of the area of black (K) to the area of the portion of yellow (Y) not overlapped by black (K) when the inkjet head 16 is moved rightward is approximately equivalent to the ratio of the area of yellow (Y) to the area of the portion of black (K) not overlapped by yellow (Y) when the inkjet head 16 is moved leftward. In other words, the same approximate color tone can be reproduced when overlapping colors, whether the inkjet head 16 is moved rightward or leftward.

Components in the third embodiment having the same configuration as those in the first or second embodiment are designated with the same reference numerals, and detailed descriptions thereto are omitted.

All embodiments disclosed herein are illustrative in all aspects and should not be considered to be limiting. The technical features described in each embodiment may be combined with each other, and the scope of the present disclosure is intended to encompass all modifications within the scope of the claims and a scope equivalent to the scope of the claims.

What is claimed is:

1. A droplet ejection device comprising:

a head comprising N-number drive elements positioned to correspond to nozzles;

a driving circuit configured to drive the N-number drive elements;

a plurality of power supply circuits connected to the driving circuit; and a control circuit configured to transmit a signal to the driving circuit on the basis of image data constituted by a plurality of items of dot size data for designating a dot size to be formed for each pixel, wherein the driving circuit comprises:

N-number waveform signal selectors, each being configured to select, from among a plurality of types of waveform signals, a waveform signal to be outputted to a corresponding one of the N-number drive elements; and N-number power supply circuit selectors, each being configured to select, from among the plurality of power supply circuits, a power supply circuit to be connected to the corresponding one of the N-number drive elements, wherein the control circuit is configured to:

determine, on the basis of the image data:

N-number items of waveform signal designation information, each designating the waveform signal to be outputted to the corresponding one of the N-number drive elements; and N-number items of power supply designation information, each designating the power supply circuit to be connected to the corresponding one of the N-number drive elements; and serially transmit, via a single control line, the determined N-number items of waveform signal designation information and the determined N-number items of power supply designation information to the driving circuit, wherein each of the N-number waveform signal selectors is configured to select, according to the N-number items of waveform signal designation information received from the control circuit, the waveform signal to be outputted to the corresponding one of the N-number drive elements, and wherein each of the N-number power supply circuit selectors is configured to select, according to the N-number items of power supply designation information received from the control circuit, the power supply circuit to be connected to the corresponding one of the N-number drive elements.

2. The droplet ejecting device according to claim 1, wherein the control circuit is configured to transmit the N-number items of waveform signal designation information and the N-number items of power supply designation information every one printing interval.

3. The droplet ejecting device according to claim 1, wherein the power supply designation information includes:

first power supply designation information for designating a first power supply circuit from among the plurality of power supply circuits; and second power supply designation information for designating a second power supply circuit from among the plurality of power supply circuits, wherein the waveform signal designation information includes:

first waveform signal designation information for designating a first waveform signal from among the plurality of types of waveform signals; and second waveform signal designation information for designating a second waveform signal from among the plurality of types of waveform signals, and wherein the control circuit is configured to determine, from among a plurality of combinations, a combination of the power supply designation information and the waveform signal designation information which correspond to first dot size data, the plurality of combinations including at least a first combination and a second combination, the first combination being a combination of the first power supply designation information and the first waveform signal designation information, the second combination being a combination of the second power supply designation information and the second waveform signal designation information.

4. The droplet ejecting device according to claim 3, further comprising:

a moving mechanism configured to reciprocally move the head in a prescribed direction; and a moving direction detector configured to detect a moving direction of the head, wherein the control circuit is configured to determine, on the basis of the moving direction detected by the moving direction detector, a combination of the power supply designation information and the waveform signal designation information such that a driving voltage for a drive element positioned on an advancing direction side of the head is greater than a driving voltage for a drive element positioned on an opposite side from the advancing direction side of the head, and transmits the determined combination to the driving circuit.

5. The droplet ejecting device according to claim 3, further comprising a receiver configured to receive a user operation, wherein a voltage of the power supply circuit designated by the second power supply designation information is greater than a voltage of the power supply circuit designated by the first power supply designation information, and wherein the control circuit is configured to select one of the first combination and the second combination as the combination of the power supply designation information and the waveform signal designation information which correspond to the first dot size data.

6. The droplet ejecting device according to claim 3, further comprising a detector configured to detect a gap between the nozzles and a printing medium placed opposing the nozzles, wherein a voltage of the power supply circuit designated by the second power supply designation information is greater than a voltage of the power supply circuit designated by the first power supply designation information, and wherein the control circuit is configured to select one of the first combination and the second combination as the combination of the power supply designation information and the waveform signal designation information which correspond to the first dot size data.

7. The droplet ejecting device according to claim 3, wherein a voltage of the power supply circuit designated by the second power supply designation information is greater than a voltage of the power supply circuit designated by the first power supply designation information, and wherein the control circuit is configured to select the first combination in a case where a usage rate of the power supply circuit designated by the first power supply designation information is smaller than a usage rate of the power supply circuit designated by the second power supply designation information, and selects the second combination in a case where the usage rate of the power supply circuit designated by the second power supply designation information is smaller than the usage rate of the power supply circuit designated by the first power supply designation information.

8. A method for a droplet ejection device including: a head including N-number drive elements positioned to correspond to nozzles; a driving circuit configured to drive the N-number drive elements; and a plurality of power supply circuits connected to the driving circuit:

determining, on the basis of image data constituted by a plurality of items of dot size data for designating a dot size to be formed for each pixel:

N-number items of waveform signal designation information, each designating a waveform signal to be outputted to a corresponding one of the N-number drive elements; and N-number items of power supply designation information, each designating a power supply circuit to be connected to the corresponding one of the N-number drive elements;

serially transmitting, to the driving circuit via a single control line, the determined N-number items of waveform signal designation information and the determined N-number items of power supply designation information;

selecting, for each of the N-number drive elements, the waveform signal from among a plurality of types of waveform signals according to the N-number items of waveform signal designation information received by the driving circuit; and selecting, for each of the N-number drive elements, the power supply circuit from among the plurality of power supply circuits according to the N-number items of power supply designation information received by the driving circuit.

* * * * *